United States Patent [19]

Johnson

[11] 4,332,579

[45] Jun. 1, 1982

[54] PRODUCTION OF CASES

[75] Inventor: Frederick P. Johnson, Audenshaw, England

[73] Assignee: Simon Container Machinery Limited, Stockport, England

[21] Appl. No.: 63,690

[22] Filed: Aug. 6, 1979

[51] Int. Cl.[3] ..... B31B 1/06

[52] U.S. Cl. ..... 493/325; 271/4; 493/55; 493/72

[58] Field of Search ..... 93/36 R, 36 A, 52, 49 R, 93/93 C, 93 HT, 93 R, 58 R, 58.2 R; 271/4, 5, 6, 7; 493/325, 324, 321, 53–55, 69, 71, 72, 270, 287, 295

[56] References Cited

U.S. PATENT DOCUMENTS

| | | | |
|---|---|---|---|
| 3,371,585 | 3/1968 | Moser et al. | 93/52 |
| 3,410,183 | 11/1968 | Sarka | 93/58.2 R |
| 3,611,884 | 10/1971 | Hottendorf | 93/58.2 R X |
| 3,653,304 | 4/1972 | Lenoir | 93/36 A X |
| 3,998,448 | 12/1976 | Gray et al. | 271/159 X |
| 4,078,956 | 3/1978 | Scheck | 93/58 R X |
| 4,134,330 | 1/1979 | Weickenmeier | 93/93 C X |

*Primary Examiner*—James F. Coan

*Attorney, Agent, or Firm*—Norris & Bateman

[57] ABSTRACT

A method and apparatus for converting box blanks into formed but collapsed cases, the apparatus comprising means (15, 16) for receiving a vertical stack(s) of blanks, means (18, 19) for elevating and supporting the stack such that the top of the stack is continually elevated into position against a feeding mechanism (17) at a fixed elevated level, the apparatus further comprising a line of casemaking machinery (10*a,* 10*b,* 11, 12, 13, 14), all arranged at the elevated level of the feeding mechanism (17).

3 Claims, 1 Drawing Figure

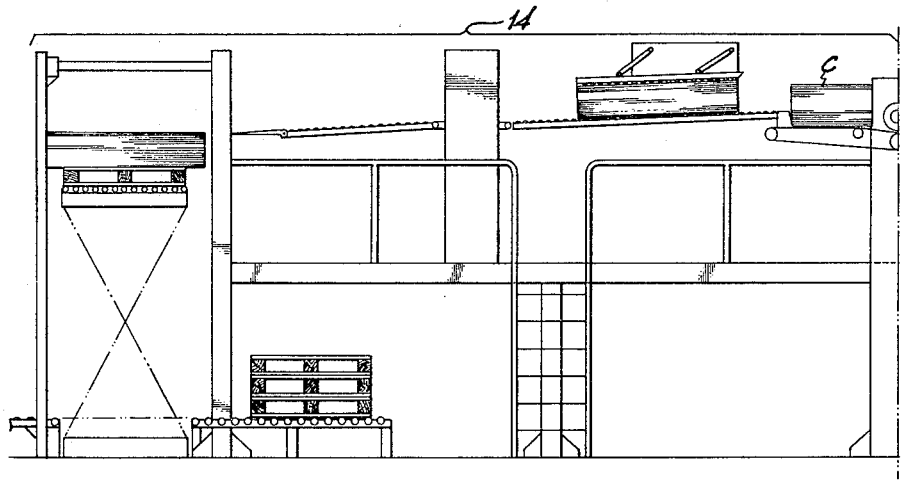
14
C
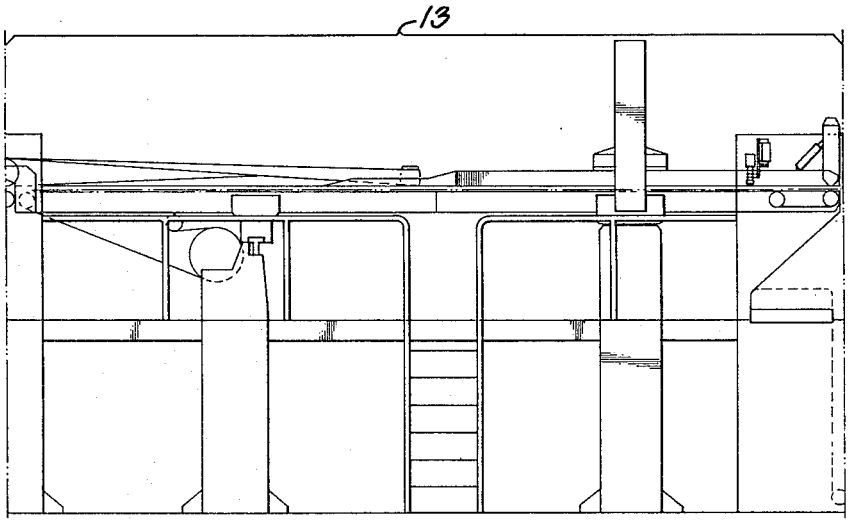
13
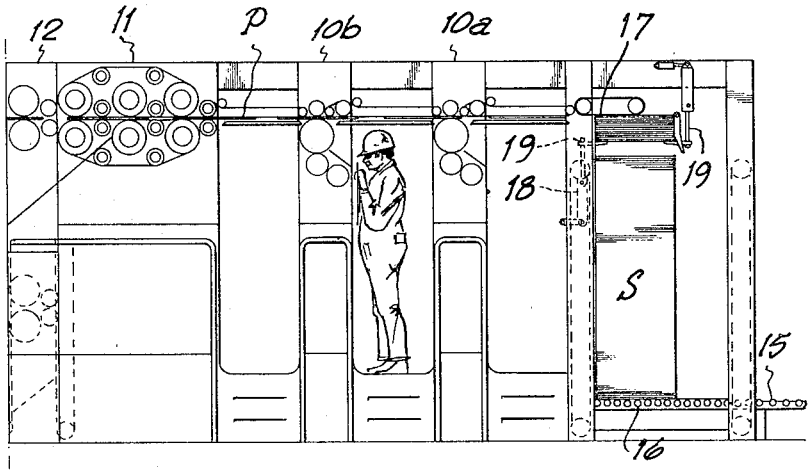
12
11
P
10b
10a
17
19
18
19
S
15
16

PRODUCTION OF CASES

This invention concerns the production of formed but collapsed cases from rectangular blanks of corrugated paper board.

In a conventional box-making plant there are two lines of machinery, the first being a line of corrugating machinery and the second being a line of case-making machinery. The line of case-making machinery receives webs of paper which are laminated to produce a corrugated paper board comprised, for example, by a paper liner disposed on each of opposite sides of a fluted paper medium. The board is slit longitudinally and provided with longitudinal score lines before being cut transversely into rectangular box blanks which are arranged in vertical stacks for later supply to the line of case-making machinery.

In the line of case-making machinery the box blanks are passed through printing machines, slotting and creasing machines and a so-called folder-gluer to produce formed but collapsed cases which are collected in bundles for dispatch.

Conventionally box blanks are fed into the line of case-making machinery by a sheet feeder which feeds the blanks one at a time from the underside of a small supply thereof contained within a hopper.

Replenishment of the hopper has always been an at least partially manual operation, and for this reason the hopper is arranged at a low level between say 800 mm and 1,000 mm above floor level. The stacks of blanks delivered from the corrugator, however, can be up to 1,8000 mm high and delivered on a roller conveyor system itself some 300 mm above floor level. It follows that the act of transferring blanks from the top of the stacks to the hopper of the sheet feeder is arduous even though special machinery has been developed to assist in the operation.

The present invention is based upon an appreciation of the possibility of eliminating the need for this manual operation or for a machine to replace it by the simple expedient of arranging the path along which the box blanks pass in the line of case-making machinery at an elevated level.

According to the present invention a method of converting box blanks into formed but collapsed cases in a line of case-making machinery comprising the steps of receiving at the commencement of the line a vertical stack of the box blanks elevating the stack continuously towards a suitable feed mechanism which engages with the top of the stack whilst the feed mechanism feeds them one at a time from the top of the stack individually and directly into the line of case-making machinery.

The invention also includes apparatus enabling practice of the method aforesaid.

The invention will be further apparent from the following description with reference to the single FIGURE of the accompanying drawing which shows, by way of example only, a side elevation of a line of case-making machinery arranged for practising the method of the invention.

Referring now to the drawing it will be seen that the line of case-making machinery includes, in known manner, printing machines 10*a* and 10*b*, a slotting and creasing machine 11, a rotary die cutting machine 12 and a folder-gluer 13. Rectangular blanks pass through the line of case-making machinery along the horizontal path indicated at P to be converted into formed but collapsed cases C which are counted, collected into bundles and stacked for dispatch by handling equipment generally indicated at 14.

In accordance with the invention the path P along which the box blanks pass is at an elevated position, for example, 2.5 meters, above floor level. Vertical stacks S of the rectangular box blanks are delivered from the line of corrugating machinery or a store by means of a roller conveyor system indicated at 15. As shown these stacks S have a height in the order of the height of a worker at the machinery.

Each stack S can be positioned on a table 16 so that it is located beneath feed mechanism indicated at 17. The arrangement is such that the path P is somewhat above the level of the top of the stacks S as they are positioned beneath the mechanism 17. In use the table 16 is elevated by driving mechanism generally indicated at 18 to bring the top of the stack S into engagement with the feed mechanism 17 which feeds the box blanks individually directly into the line of case-making machinery along the path P. The stack S is elevated continually as feeding takes place. Before the stack S is fully exhausted the remaining portion thereof is gripped and supported by mechanism 19 which also continues to elevate the residual stack towards the feed mechanism 17 whilst permitting the table 16 to be returned to its lower position for receipt of a new stack S. In this way the feed of blanks can continue without interruption.

Equally full height stacks may be reformed at the output end of the line on a table which is lowered as the stack is formed.

The arrangement has further advantages. Thus, for example, as can clearly be seen from the drawing, an operator can have easy access to each of the printing machines 10*a* and 10*b* for set-up and related purposes.

Equally, means such as the rotary die cutter 12, for example, can be moved to a lowered position as indicated in broken lines for setting and maintenance. This is generally more convenient than drawing such machinery from the line transversely as is customary with a conventional line of case-making machinery.

Yet again, scrap material such as the trim produced by the slotting and creasing machine 11 and rotary die cutting machine 12 can be more conveniently collected by means of chutes 20 leading to extraction equipment than the conveyors conventionally provided and necessary when these machines are at ground level.

It will be appreciated that it is not intended to limit the invention to the above example only, many variations, such as might readily occur to one skilled in the art, being possible without departing from the scope thereof.

I claim:

1. A method of converting box blanks into formed but collapsed cases in a system wherein tall vertical stacks of said blanks each of an appreciable height corresponding substantially to the height of a worker are successively conveyed from corrugating machinery to a line of casemaking machinery, comprising providing an elevated line of casemaking machinery, introducing at the commencement of the line one of said tall vertical stacks of box blanks arising from a support, said line having a working path extending at a level above the top of said stack, elevating the support to raise the stack continuously towards a suitable feed mechanism disposed at the level of said path which engages with the top blank of the stack, and actuating the feed mechanism to horizontally feed said blanks one at a time in timed sequence from the top of the rising stack individually and directly into the line of casemaking machinery, and wherein after the residual rising stack is depleted to a relatively short vertical dimension, said residual rising stack is separated from the support and temporarily supported and continues to be elevated by means which engage the bottom of the stack, returning the support down to its initial position and placing thereupon a further tall vertical stack of blanks of said appreciable height in the space below said short stack, elevating said support until the top blank of the further stack is at the base of said shorter stack and withdrawing said engaging means so that the short stack becomes supported by the rising further stack and both stacks are now continuously elevated as one towards the feeding mechanism, thereby to provide substantially uninterupted supply of blanks to said casemaking machinery.

2. Apparatus according to claim 1, wherein the said fixed level is in the region of 2.5 meters above the floor on which the apparatus stands.

3. A method according to claim 1, wherein the box blanks are successively fed along said line through a printing machine, a slotting and creasing machine, a rotary die cutting machine, a folder-gluer, and means for counting and collecting the formed but collapsed cases from the line and assembling same into bundles for despatch, and the bundles of cases are deposited onto a descending table to re-form there a stack to a height substantially equal to that of the vertical stack of box blanks earlier received.

* * * * *